US011199345B2

(12) United States Patent
Araki

(10) Patent No.: US 11,199,345 B2
(45) Date of Patent: Dec. 14, 2021

(54) HEAT EXCHANGE UNIT AND REFRIGERATION CYCLE APPARATUS

(71) Applicant: Mitsubishi Electric Corporation, Tokyo (JP)

(72) Inventor: Ryohei Araki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 13 days.

(21) Appl. No.: 16/620,928

(22) PCT Filed: Aug. 8, 2017

(86) PCT No.: PCT/JP2017/028707
§ 371 (c)(1),
(2) Date: Dec. 10, 2019

(87) PCT Pub. No.: WO2019/030812
PCT Pub. Date: Feb. 14, 2019

(65) Prior Publication Data
US 2020/0200450 A1 Jun. 25, 2020

(51) Int. Cl.
*F25B 1/00* (2006.01)
*F25B 39/00* (2006.01)
*F25B 39/02* (2006.01)

(52) U.S. Cl.
CPC ..... *F25B 39/00* (2013.01); *F25B 39/028* (2013.01)

(58) Field of Classification Search
CPC ..... F25B 39/04; F25B 39/00; F25B 39/028; F25B 41/00; F25B 41/42; F28F 9/027; F28F 9/0275
See application file for complete search history.

(56) References Cited

U.S. PATENT DOCUMENTS

2018/0058736 A1* 3/2018 Jin ..... F28F 9/162

FOREIGN PATENT DOCUMENTS

CN 206146052 U 5/2017
JP H10-019416 A 1/1998
(Continued)

OTHER PUBLICATIONS

The attached pdf file is the translation of the foreign reference JP 2010127601 A (Year: 2010).*
(Continued)

*Primary Examiner* — Henry T Crenshaw
*Assistant Examiner* — Kamran Tavakoldavani
(74) *Attorney, Agent, or Firm* — Posz Law Group, PLC

(57) ABSTRACT

A heat exchange unit includes a heat exchanger including a plurality of heat transfer tubes and a plurality of refrigerant distributors. Each of the plurality of refrigerant distributors includes an inlet pipe through which refrigerant flows into the refrigerant distributor and a plurality of distribution pipes through which the refrigerant flows out of the refrigerant distributor. Each of the plurality of distribution pipes is connected to a corresponding one of the plurality of heat transfer tubes. The inlet pipe of the refrigerant distributor having a relatively low average value of levels of the plurality of distribution pipes connected to the plurality of heat transfer tubes has a smaller inside diameter than the inlet pipe of the refrigerant distributor having a relatively high average value of levels of the plurality of distribution pipes connected to the plurality of heat transfer tubes.

7 Claims, 8 Drawing Sheets

(56) References Cited

FOREIGN PATENT DOCUMENTS

| | | | | |
|---|---|---|---|---|
| JP | 2000-274885 | A | | 10/2000 |
| JP | 2007-248006 | A | | 9/2007 |
| JP | 2008-075929 | A | | 4/2008 |
| JP | 2010-127601 | A | | 6/2010 |
| JP | 2010127601 | A | * | 6/2010 |
| JP | 2014-020696 | A | | 2/2014 |
| WO | 2015/111220 | A1 | | 7/2015 |

OTHER PUBLICATIONS

International Search Report of the International Searching Authority dated Oct. 24, 2017 for the corresponding International application No. PCT/JP2017/028707 (and English translation).
Extended European Search Report dated Mar. 6, 2019 issued in corresponding EP patent application No. 17882269.8.
Chinese Office Action dated Jan. 25, 2021, issued in corresponding Chinese patent application 201780093588.1 (and English machine translation).
Extended European Search Report dated Mar. 24, 2020 issued in corresponding European patent application No. 19202275.4.
Office Action dated Jul. 7, 2021 issued in corresponding CN patent application No. 201780093588.1 (and English translation).

* cited by examiner

10

HEAT EXCHANGE UNIT AND REFRIGERATION CYCLE APPARATUS

CROSS REFERENCE TO RELATED APPLICATION

This application is a U.S. national stage application of International Application No. PCT/JP2017/028707, filed on Aug. 8, 2017, the contents of which are incorporated herein by reference.

TECHNICAL FIELD

The present invention relates to refrigeration cycle apparatuses used for, for example, air-conditioning, freezing, and refrigerating applications and heat exchange units included in such refrigeration cycle apparatuses.

BACKGROUND

A refrigerant distributor is typically used to increase the efficiency of heat exchange in a heat exchanger of a heat exchange unit included in a refrigeration cycle apparatus. The refrigerant distributer includes an inlet pipe connected to a refrigerant inlet open end of the refrigerant distributor and a plurality of distribution pipes, each of which is connected to a corresponding one of a plurality of refrigerant outlet open ends of the refrigerant distributor. For increase in heat exchange efficiency in the heat exchanger, such a refrigerant distributer is required to equalize the outflow of fluid to achieve an appropriate pass balance after distribution. For example, Patent Literature 1 describes the arrangement of a cylindrical throttling member inside a dividing pipe, serving as a refrigerant distributor, to achieve an appropriate pass balance after distribution. The throttling member has an inner circumferential surface whose shape is determined based on functions required for the dividing pipe. Patent Literature 1 discloses a configuration in which the throttling member is attached to the inside of an inlet open end of the dividing pipe or an outlet open end thereof.

PATENT LITERATURE

Patent Literature 1: Japanese Unexamined Patent Application Publication No. 2000-274885

For the configuration disclosed in Patent Literature 1, however, the throttling member needs to be fabricated as a member separate from the dividing pipe. In addition, since the throttling member is attached to at least one of the open ends of the dividing pipe, high dimensional accuracy is required for the inside diameter of each open end of the dividing pipe and the outside diameter of the throttling member. Furthermore, fabrication involves attaching the throttling member to the open end of the dividing pipe. In other words, the dividing pipe disclosed in Patent Literature 1 has a complicated configuration, and it is therefore difficult to fabricate the dividing pipe.

SUMMARY

The present invention has been made to overcome the above-described disadvantages, and aims to provide a heat exchange unit including a refrigerant distributer that has a simple configuration and that is easy to fabricate and a refrigeration cycle apparatus including the refrigerant distributor.

A heat exchange unit according to an embodiment of the present invention includes a heat exchanger including a plurality of heat transfer tubes and at least one refrigerant distributor. The refrigerant distributer includes an inlet pipe through which refrigerant flows into the refrigerant distributor and a plurality of distribution pipes through which the refrigerant flows out of the refrigerant distributor. Each of the plurality of distribution pipes is connected to a corresponding one of the plurality of heat transfer tubes. The distribution pipe that is included in the plurality of distribution pipes and that is connected at a relatively low level to the heat transfer tube has a smaller inside diameter than the distribution pipe that is included in the plurality of distribution pipes and that is connected at a relatively high level to the heat transfer tube.

A heat exchange unit according to another embodiment of the present invention includes a heat exchanger including a plurality of heat transfer tubes and a plurality of refrigerant distributors. Each of the plurality of refrigerant distributors includes an inlet pipe through which refrigerant flows into the refrigerant distributor and a plurality of distribution pipes through which the refrigerant flows out of the refrigerant distributor. Each of the plurality of distribution pipes is connected to a corresponding one of the plurality of heat transfer tubes. The inlet pipe of the refrigerant distributor having a relatively low average value of levels of the plurality of distribution pipes connected to the plurality of heat transfer tubes has a smaller inside diameter than the inlet pipe of the refrigerant distributor having a relatively high average value of levels of the plurality of distribution pipes connected to the plurality of heat transfer tubes.

A refrigeration cycle apparatus according to another embodiment of the present invention includes a refrigerant circuit in which a compressor, a condenser, a pressure reducing valve, and an evaporator are sequentially connected by a refrigerant pipe and at least one refrigerant distributor. The refrigerant distributor includes an inlet pipe through which refrigerant in the refrigerant circuit flows into the refrigerant distributor and a plurality of distribution pipes through which the refrigerant flows out of the refrigerant distributor. Each of the plurality of distribution pipes is connected to a corresponding one of a plurality of heat transfer tubes included in the evaporator. The distribution pipe that is included in the plurality of distribution pipes and that is connected at a relatively low level to the heat transfer tube has a smaller inside diameter than the distribution pipe that is included in the plurality of distribution pipes and that is connected at a relatively high level to the heat transfer tube.

A refrigeration cycle apparatus according to another embodiment of the present invention includes a refrigerant circuit in which a compressor, a condenser, a pressure reducing valve, and an evaporator are sequentially connected by a refrigerant pipe and a plurality of refrigerant distributors. Each of the plurality of refrigerant distributors includes an inlet pipe through which refrigerant in the refrigerant circuit flows into the refrigerant distributor and a plurality of distribution pipes through which the refrigerant flows out of the refrigerant distributor. Each of the plurality of distribution pipes is connected to a corresponding one of a plurality of heat transfer tubes included in the evaporator. The inlet pipe of the refrigerant distributor having a relatively low average value of levels of the plurality of distribution pipes connected to the plurality of heat transfer tubes has a smaller inside diameter than the inlet pipe of the refrigerant distributor having a relatively high average value of levels of the plurality of distribution pipes connected to the plurality of heat transfer tubes.

The heat exchange units according to the embodiments of the present invention can achieve a good pass balance of the refrigerant in the heat exchanger and prevent a reduction in heat exchange efficiency with a simple configuration. Furthermore, the refrigeration cycle apparatuses according to the embodiments of the present invention can achieve a good pass balance of the refrigerant in the evaporator and prevent a reduction in heat exchange efficiency with a simple configuration.

DETAILED DESCRIPTION

Embodiments of heat exchange units and refrigeration cycle apparatuses according to the present invention will be described in detail below with reference to the drawings. The following embodiments should not be construed as limiting the present invention. Note that the relative sizes of components illustrated in the following figures may differ from those in actual apparatuses.

Embodiment 1

Figure 1:
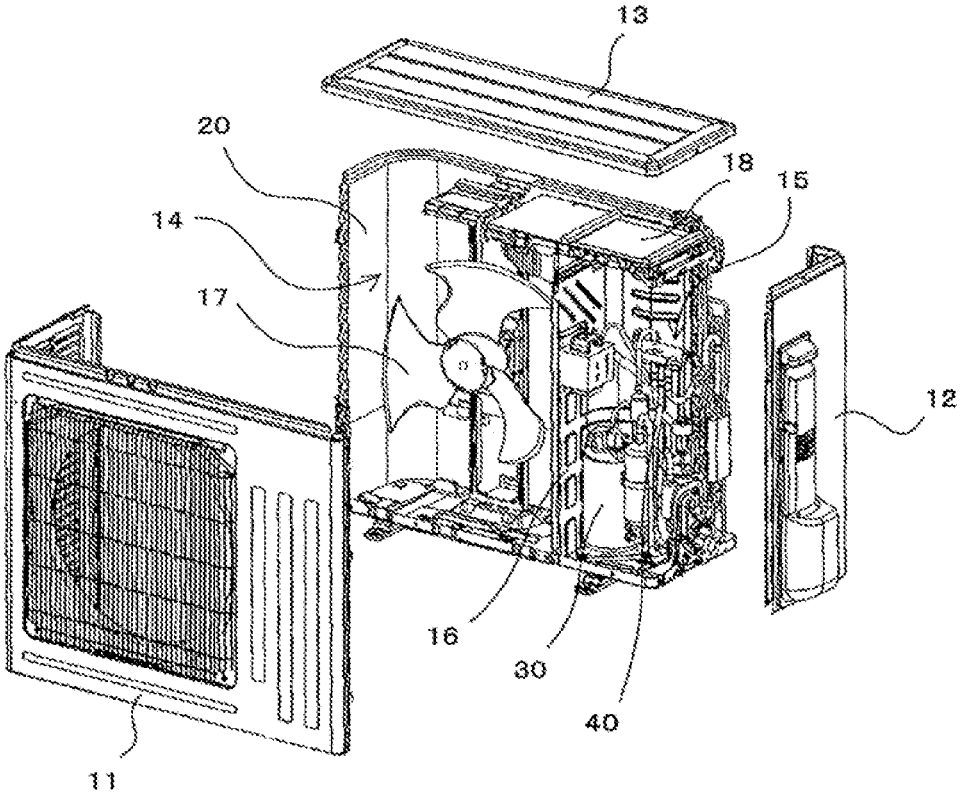
FIG. 1 is an exploded perspective view of a heat exchange unit according to Embodiment 1 of the present invention.

FIG. 1 is an exploded perspective view of a heat exchange unit according to Embodiment 1 of the present invention. As illustrated in FIG. 1, the heat exchange unit according to Embodiment 1 is an outdoor unit 10. The outdoor unit 10 includes a shell including a front panel 11, a side panel 12, and a top panel 13. The outdoor unit 10 includes a fan chamber 14 and a machine chamber 15. The fan chamber 14 is separated from the machine chamber 15 by a partition 16.

The fan chamber 14 accommodates a heat exchanger 20 and a fan 17, which supplies outdoor air to the heat exchanger 20. The machine chamber 15 accommodates in its lower part a compressor 30 and a refrigerant pipe 40, which are included in a refrigeration cycle apparatus. The refrigeration cycle apparatus will be described later. The machine chamber 15 accommodates in its upper part an electric component 18.

Figure 2:
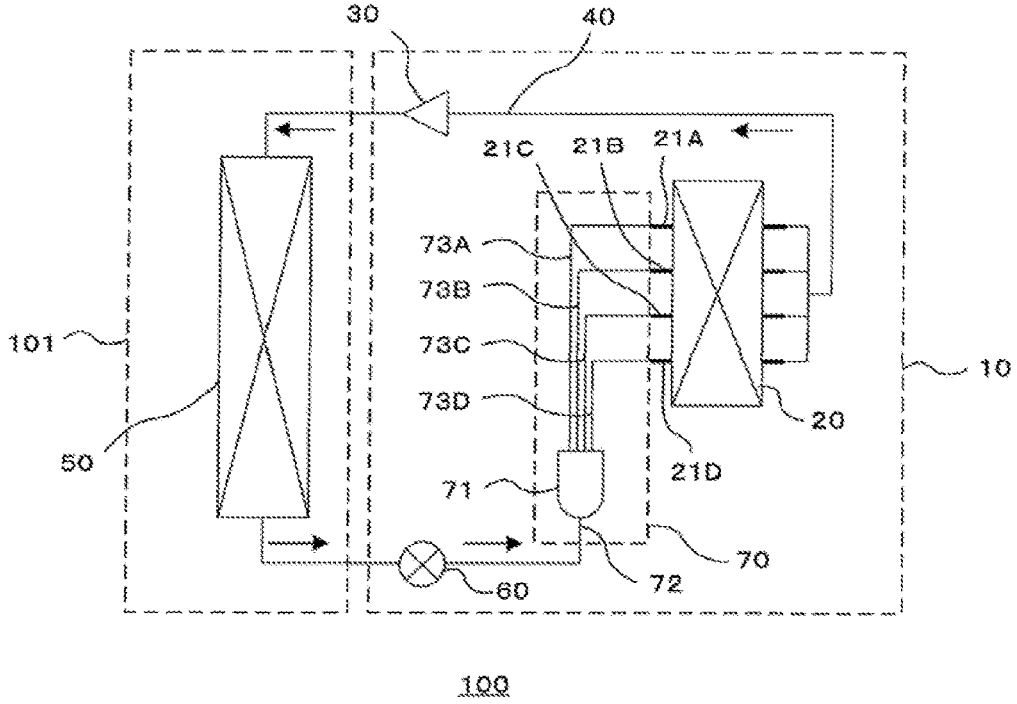
FIG. 2 is a refrigerant circuit diagram of a refrigeration cycle apparatus according to Embodiment 1 of the present invention.

FIG. 2 is a refrigerant circuit diagram of the refrigeration cycle apparatus according to Embodiment 1 of the present invention. FIG. 2 is a diagram illustrating a refrigerant circuit for a heating operation, and illustrates the flow of refrigerant indicated by arrows. A refrigeration cycle apparatus 100 includes the compressor 30, a heat exchanger 50, a pressure reducing valve 60, a refrigerant distributor 70, and the heat exchanger 20, which are sequentially connected by the refrigerant pipe 40. The refrigerant distributor 70 includes a distributor body 71, an inlet pipe 72 through which the refrigerant enclosed in the refrigerant pipe 40 flows into the refrigerant distributor, and four distribution pipes 73A, 73B, 73C, and 73D through which the refrigerant flows out of the refrigerant distributor. The inlet pipe 72 is connected to the refrigerant pipe 40. Specifically, the refrigerant distributor 70 is connected between the pressure reducing valve 60 and the heat exchanger 20 in the refrigeration cycle apparatus 100. The compressor 30, the pressure reducing valve 60, the refrigerant distributor 70, and the heat exchanger 20 are included in the above-described outdoor unit 10. The heat exchanger 50 is included in an indoor unit 101. In Embodiment 1, the heat exchanger 20 operates as an evaporator, and the heat exchanger 50 operates as a condenser. The outdoor unit 10 corresponds to the heat exchange unit in the present invention.

Figure 3:
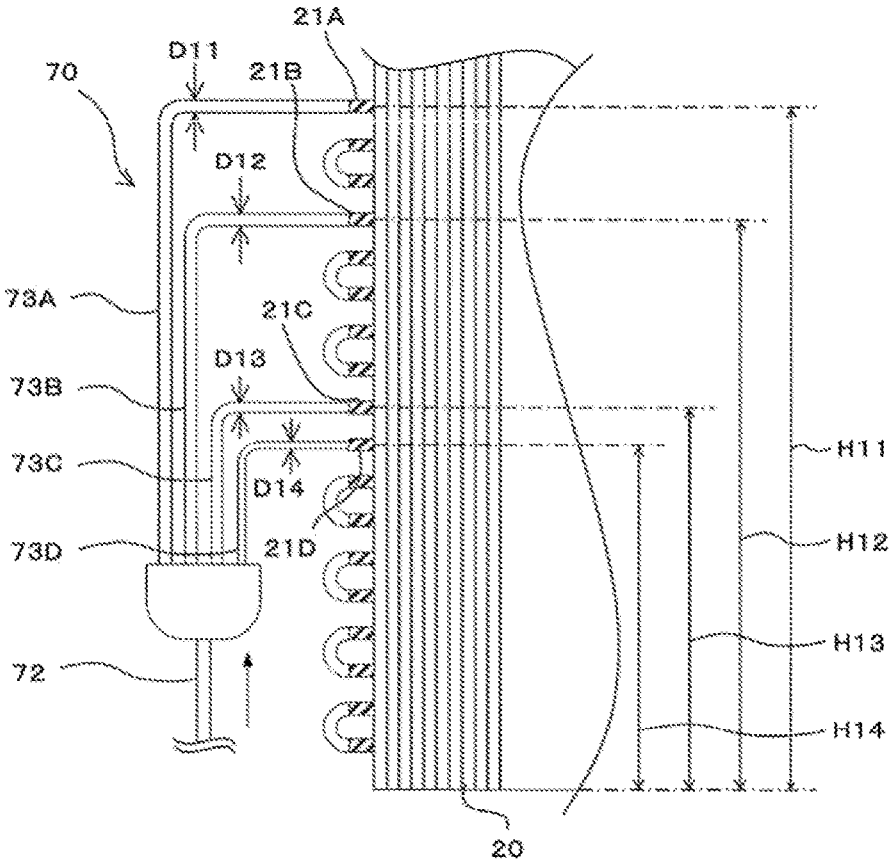
FIG. 3 is a diagram illustrating essential part of a heat exchanger according to Embodiment 1 of the present invention.

FIG. 3 is a diagram illustrating essential part of the heat exchanger according to Embodiment 1 of the present invention. In Embodiment 1, each of the four distribution pipes 73A, 73B, 73C, and 73D is connected to a corresponding one of heat transfer tubes 21A, 21B, 21C, and 21D of the heat exchanger 20. In the following description, the distribution pipes 73A, 73B, 73C, and 73D may be collectively referred to as "distribution pipes 73", and the heat transfer tubes 21A, 21B, 21C, and 21D may be collectively referred to as "heat transfer tubes 21". The distribution pipe 73A is connected at a level indicated by H11 to the heat transfer tube 21A. The distribution pipe 73B is connected at a level indicated by H12 to the heat transfer tube 21B. The distribution pipe 73C is connected at a level indicated by H13 to the heat transfer tube 21C. The distribution pipe 73D is connected at a level indicated by H14 to the heat transfer tube 21D. The term "level of the distribution pipe 73 connected to the heat transfer tube 21" as used herein refers to a distance from the lowermost end of the heat exchanger 20 to the axis of the distribution pipe 73 in a top-bottom direction of the heat exchanger 20.

The level H12 of the distribution pipe 73B connected to the heat transfer tube 21B is lower than the level H11 of the distribution pipe 73A connected to the heat transfer tube 21A. The distribution pipe 73B has an inside diameter D12, which is smaller than an inside diameter D11 of the distribution pipe 73A. The level H13 of the distribution pipe 73C connected to the heat transfer tube 21C is lower than the level H12 of the distribution pipe 73B connected to the heat transfer tube 21B. The distribution pipe 73C has an inside diameter D13, which is smaller than the inside diameter D12 of the distribution pipe 73B. The level H14 of the distribution pipe 73D connected to the heat transfer tube 21D is lower than the level H13 of the distribution pipe 73C connected to the heat transfer tube 21C. The distribution pipe 73D has an inside diameter D14, which is smaller than the inside diameter D13 of the distribution pipe 73C. In other words, the inside diameter of the distribution pipe 73 connected at a relatively low level to the heat transfer tube 21 is smaller than the inside diameter of the distribution pipe 73 connected at a relatively high level to the heat transfer tube 21.

Gravity causes the flow rate of the refrigerant through the distribution pipe 73 connected at a relatively low level to the heat transfer tube 21 to be greater than that through the distribution pipe 73 connected at a relatively high level to the heat transfer tube 21. In Embodiment 1, however, the inside diameter of the distribution pipe 73 connected at a relatively low level to the heat transfer tube 21 is smaller than that of the distribution pipe 73 connected at a relatively high level to the heat transfer tube 21. This arrangement eliminates imbalance in the flow rate of the refrigerant between the distribution pipes 73, thus preventing a deterioration in pass balance in the heat exchanger 20 operating as an evaporator and a reduction in heat exchange efficiency.

Furthermore, in Embodiment 1, the deterioration in pass balance in the heat exchanger 20 is prevented only by appropriately setting the inside diameters of the distribution pipes 73 connected to the distributor body 71. In other words, the heat exchange efficiency in the outdoor unit 10 and the refrigeration cycle apparatus 100 can be increased by disposing the refrigerant distributor 70, which has a simple configuration and is easy to fabricate, adjacent to the heat exchanger 20.

Embodiment 2

Figure 4:
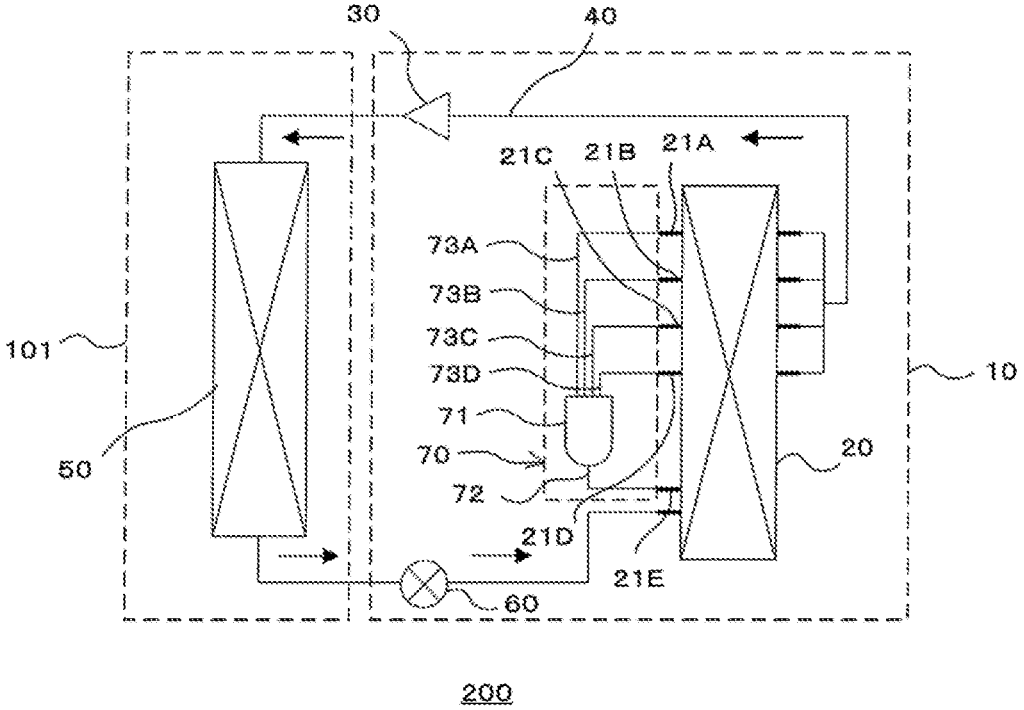
FIG. 4 is a refrigerant circuit diagram of a refrigeration cycle apparatus according to Embodiment 2 of the present invention.
Figure 5:
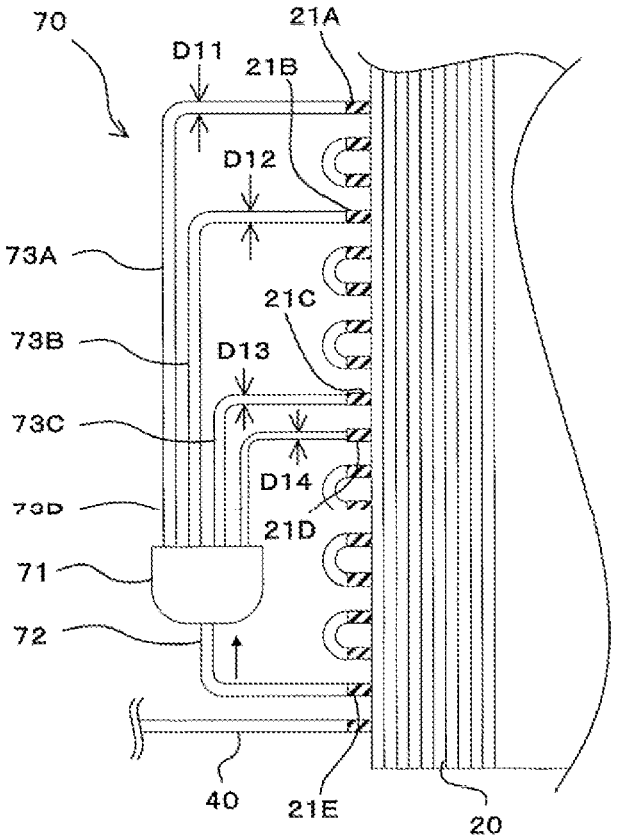
FIG. 5 is a diagram illustrating essential part of a heat exchanger according to Embodiment 2 of the present invention.

FIG. 4 is a refrigerant circuit diagram of a refrigeration cycle apparatus according to Embodiment 2 of the present invention. FIG. 5 is a diagram illustrating essential part of a heat exchanger according to Embodiment 2 of the present invention. Like FIG. 2, FIG. 4 is a diagram illustrating a refrigerant circuit for the heating operation, and illustrates the flow of refrigerant indicated by arrows. In FIGS. 4 and 5, the same components as those in the refrigeration cycle apparatus according to Embodiment 1 described above are designated by the same reference signs. In a refrigeration cycle apparatus 200 according to Embodiment 2, the inlet pipe 72 of the refrigerant distributor 70 is connected to a heat transfer tube 21E of the heat exchanger 20. In other words, the refrigerant distributor 70 is disposed inside the heat exchanger 20, serving as an evaporator. The other configuration is the same as that in Embodiment 1. The inside diameter of the distribution pipe 73 connected at a relatively low level to the heat transfer tube 21 is smaller than that of the distribution pipe 73 connected at a relatively high level to the heat transfer tube 21.

According to Embodiment 2, the inside diameter of the distribution pipe 73 connected at a relatively low level to the heat transfer tube 21 is smaller than that of the distribution pipe 73 connected at a relatively high level to the heat transfer tube 21. As in Embodiment 1, therefore, this arrangement eliminates imbalance in the flow rate of the refrigerant between the distribution pipes 73, thus preventing a deterioration in pass balance in the heat exchanger 20 operating as an evaporator and a reduction in heat exchange efficiency.

Furthermore, according to Embodiment 2, the deterioration in pass balance in the heat exchanger 20 is prevented only by appropriately setting the inside diameters of the distribution pipes 73 connected to the distributor body 71. In other words, as in Embodiment 1, the heat exchange efficiency in the outdoor unit 10 and the refrigeration cycle apparatus 100 can be increased by disposing the refrigerant distributor 70, which has a simple configuration and is easy to fabricate, in the heat exchanger 20.

Figure 6:
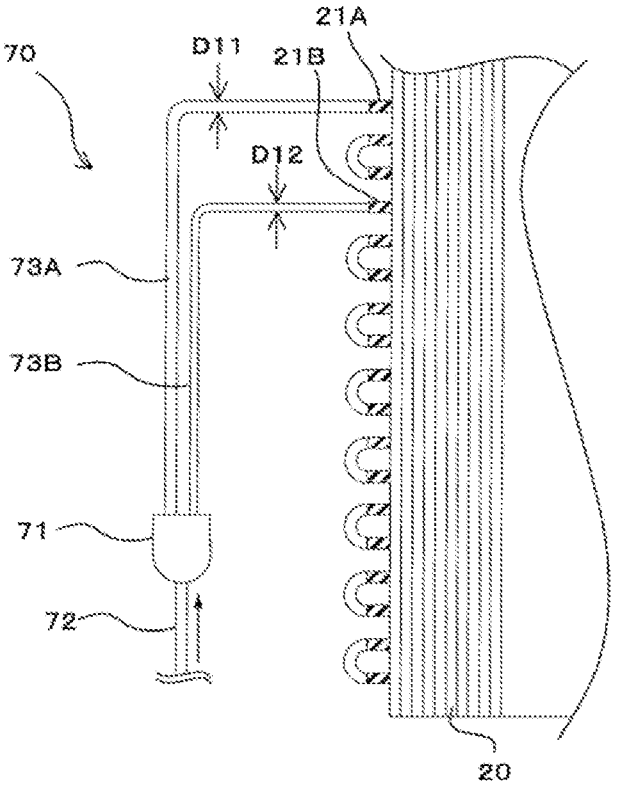
FIG. 6 is a diagram illustrating essential part of a heat exchanger according to a modification of Embodiment 1 of the present invention.

FIG. 6 is a diagram illustrating essential part of a heat exchanger according to a modification of Embodiment 1 of the present invention. In Embodiments 1 and 2, the refrigerant distributor 70 includes the four distribution pipes 73A, 73B, 73C, and 73D. The refrigerant distributor 70 may include any number of distribution pipes 73. The refrigerant distributor 70 in the modification illustrated in FIG. 6 includes two distribution pipes 73A and 73B. The distribution pipe 73B is connected to the heat transfer tube 21B at a lower level than the distribution pipe 73A connected to the heat transfer tube 21A. The distribution pipe 73B has a smaller inside diameter than the distribution pipe 73A. This arrangement offers the same advantages as those of Embodiments 1 and 2 described above.

Embodiment 3

Figure 7:
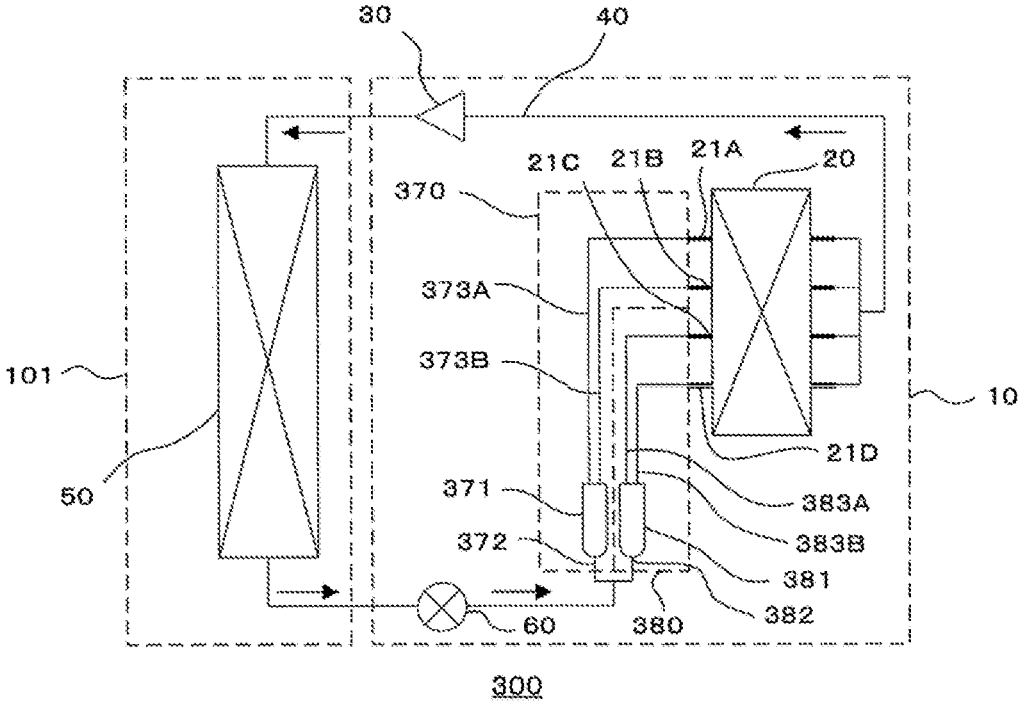
FIG. 7 is a refrigerant circuit diagram of a refrigeration cycle apparatus according to Embodiment 3 of the present invention.
Figure 8:
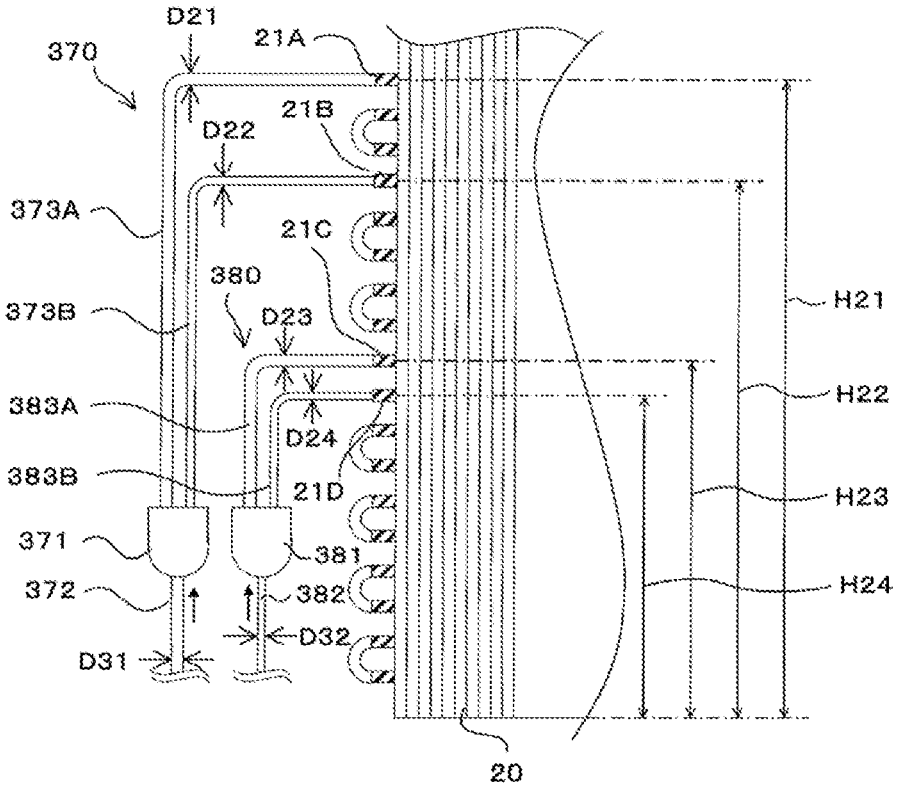
FIG. 8 is a diagram illustrating essential part of a heat exchanger according to Embodiment 3 of the present invention.

FIG. 7 is a refrigerant circuit diagram of a refrigeration cycle apparatus according to Embodiment 3 of the present invention. FIG. 8 is a diagram illustrating essential part of a heat exchanger according to Embodiment 3 of the present invention. Like FIGS. 2 and 4, FIG. 7 is a diagram illustrating a refrigerant circuit for the heating operation, and illustrates the flow of refrigerant indicated by arrows. In FIGS. 7 and 8, the same components as those of the refrigeration cycle apparatuses according to Embodiments 1 and 2 described above are designated by the same reference signs. In Embodiment 3, a refrigerant distributor 370 and a refrigerant distributor 380 are arranged in a refrigeration cycle apparatus 300. The refrigerant distributor 370 includes a distributor body 371, an inlet pipe 372 through which the refrigerant enclosed in the refrigerant pipe 40 flows into the refrigerant distributor, and two distribution pipes 373A and 373B through which the refrigerant flows out of the refrigerant distributor. The inlet pipe 372 is connected to the refrigerant pipe 40. The refrigerant distributor 380 includes a distributor body 381, an inlet pipe 382 through which the refrigerant enclosed in the refrigerant pipe 40 flows into the refrigerant distributor, and two distribution pipes 383A and 383B through which the refrigerant flows out of the refrigerant distributor. The inlet pipe 382 is connected to the refrigerant pipe 40. Specifically, the refrigerant distributors 370 and 380 are connected between the pressure reducing valve 60 and the heat exchanger 20 in the refrigeration cycle apparatus 300.

Each of the two distribution pipes 373A and 373B of the refrigerant distributor 370 is connected to a corresponding one of the heat transfer tubes 21A and 21B of the heat exchanger 20. Each of the two distribution pipes 383A and 383B of the refrigerant distributor 380 is connected to a corresponding one of the heat transfer tubes 21C and 21C of the heat exchanger 20. In the following description, the distribution pipes 373A and 373B may be collectively referred to as "distribution pipes 373", and the distribution pipes 383A and 383B may be collectively referred to as "distribution pipes 383".

Referring to FIG. 8, the distribution pipe 373A is connected at a level indicated by H21 to the heat transfer tube 21A. The distribution pipe 373B is connected at a level indicated by H22 to the heat transfer tube 21B. The distribution pipe 383A is connected at a level indicated by H23 to the heat transfer tube 21C. The distribution pipe 383B is connected at a level indicated by H24 to the heat transfer tube 21D. In a comparison between an average value of the levels H21 and H22 and an average value of the levels H23 and H24, the latter is less than the former. Specifically, the average value of the levels of the distribution pipes 383A and 383B of the refrigerant distributor 380 connected to the heat transfer tubes 21C and 21D is less than the average value of the levels of the distribution pipes 373A and 373B of the refrigerant distributor 370 to the heat transfer tubes 21A and 21B. The inlet pipe 382 of the refrigerant distributor 380 has an inside diameter D32, which is smaller than an inside diameter D31 of the inlet pipe 372 of the refrigerant distributor 370. In other words, the inside diameter D32 of the inlet pipe 382 of the refrigerant distributor 380 having a relatively low average value of the levels of the distribution pipes 383 connected to the heat transfer tubes 21 is smaller than the inside diameter D31 of the inlet pipe 372 of the refrigerant distributor 370 having a relatively high average value of the levels of the distribution pipes 373 connected to the heat transfer tubes 21.

Furthermore, in the refrigerant distributor 370, the inside diameter of the distribution pipe 373 connected at a relatively low level to the heat transfer tube 21 is smaller than that of the distribution pipe 373 connected at a relatively high level to the heat transfer tube 21. Specifically, the level H22 of the distribution pipe 373B connected to the heat transfer tube 21B is lower than the level H21 of the distribution pipe 373A connected to the heat transfer tube 21A. The distribution pipe 373B has an inside diameter D22, which is smaller than an inside diameter D21 of the distribution pipe 373A. Similarly, in the refrigerant distributor 380, the inside diameter of the distribution pipe 383 connected at a relatively low level to the heat transfer tube 21 is smaller than that of the distribution pipe 383 connected at a relatively high level to the heat transfer tube 21. Specifically, the level H24 of the distribution pipe 383B connected to the heat transfer tube 21D is lower than the level H23 of the distribution pipe 383A connected to the heat transfer tube 21C. The distribution pipe 383B has an inside diameter D24, which is smaller than an inside diameter D23 of the distribution pipe 383A.

Gravity causes the flow rate of the refrigerant through the distribution pipes 383 connected at relatively low levels to the heat transfer tubes 21 to be greater than the flow rate of the refrigerant through the distribution pipes 373 connected at relatively high levels to the heat transfer tubes 21. As described above, the inside diameter D32 of the inlet pipe 382 of the refrigerant distributor 380 having the relatively low average value of the levels of the distribution pipes 383 connected to the heat transfer tubes 21 is smaller than the inside diameter D31 of the inlet pipe 372 of the refrigerant distributor 370 including the distribution pipes 373 connected at relatively high levels to the heat transfer tubes 21. This arrangement according to Embodiment 3 eliminates imbalance in the flow rate of the refrigerant between the distribution pipes 373 and 383, thus preventing a deterioration in pass balance of the refrigerant in the heat exchanger 20 operating as an evaporator and a reduction in heat exchange efficiency.

For the distribution pipes 373 of the refrigerant distributor 370 and the distribution pipes 383 of the refrigerant distributor 380, in each refrigerant distributor, the inside diameter of the distribution pipe connected at a relatively low level to the heat transfer tube 21 is smaller than that of the distribution pipe connected at a relatively high level to the heat transfer tube 21. This arrangement achieves a more appropriate pass balance of the refrigerant in the heat exchanger 20, thus maintaining high heat exchange efficiency.

Furthermore, according to Embodiment 3, the deterioration in pass balance in the heat exchanger 20 is prevented only by appropriately setting the inside diameters of the distribution pipes 73 and 83 and the inside diameters of the inlet pipes 372 and 382. In other words, the heat exchange efficiency in the outdoor unit 10 and the refrigeration cycle apparatus 200 can be increased by arranging the refrigerant distributors 370 and 380, which have a simple configuration and are easy to fabricate, adjacent to the heat exchanger 20.

Embodiment 4

Figure 9:
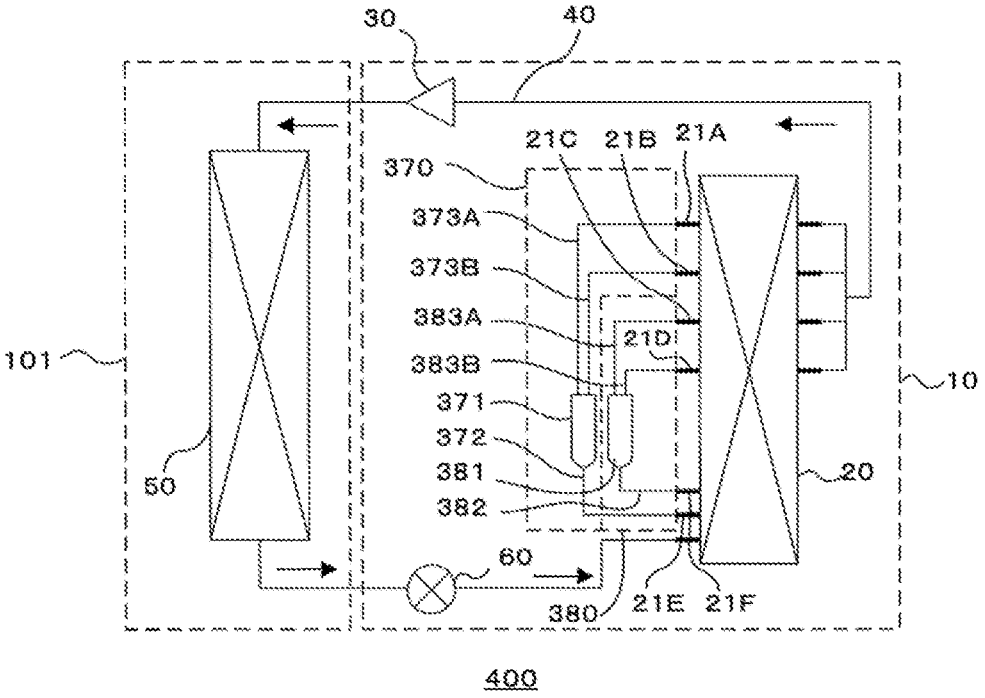
FIG. 9 is a refrigerant circuit diagram of a refrigeration cycle apparatus according to Embodiment 4 of the present invention.
Figure 10:
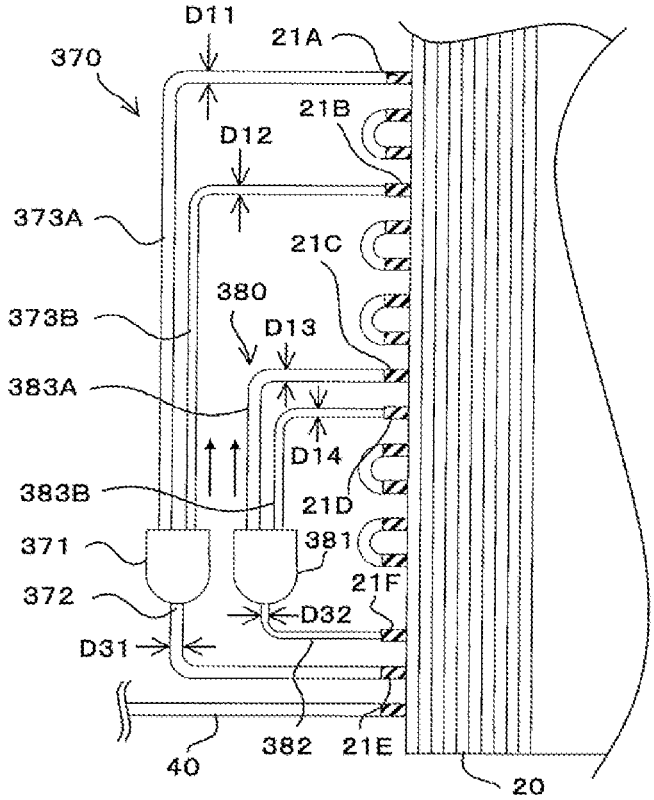
FIG. 10 is a diagram illustrating essential part of a heat exchanger according to Embodiment 4 of the present invention.

FIG. 9 is a refrigerant circuit diagram of a refrigeration cycle apparatus according to Embodiment 4 of the present invention. FIG. 10 is a diagram illustrating essential part of a heat exchanger according to Embodiment 4 of the present invention. Like FIGS. 2, 4, and 7, FIG. 9 is a diagram illustrating a refrigerant circuit for the heating operation, and illustrates the flow of refrigerant indicated by arrows. In FIGS. 9 and 10, the same components as those of the refrigeration cycle apparatuses according to Embodiments 1 to 3 described above are designated by the same reference signs. In the refrigeration cycle apparatus 400 according to Embodiment 4, the inlet pipe 372 of the refrigerant distributor 370 is connected to the heat transfer tube 21E of the heat exchanger 20, and the inlet pipe 382 of the refrigerant distributor 380 is connected to a heat transfer tube 21F of the heat exchanger 20. In other words, the refrigerant distributors 370 and 380 are arranged inside the heat exchanger 20, serving as an evaporator. The other configuration is the same as that of Embodiment 3.

In Embodiment 4, the inside diameter D32 of the inlet pipe 382 of the refrigerant distributor 380 having the relatively low average value of the levels of the distribution pipes 383 connected to the heat transfer tubes 21 is smaller than the inside diameter D31 of the inlet pipe 372 of the refrigerant distributor 370 including the distribution pipes 373 connected at relatively high levels to the heat transfer tubes 21. As in Embodiment 3, this arrangement eliminates imbalance in the flow rate of the refrigerant between the distribution pipes 373 and 383, thus preventing a deterioration in pass balance of the refrigerant in the heat exchanger 20 operating as an evaporator and a reduction in heat exchange efficiency.

For the distribution pipes 373 of the refrigerant distributor 370 and the distribution pipes 383 of the refrigerant distributor 380, in each refrigerant distributor, the inside diameter of the distribution pipe connected at a relatively low level to the heat transfer tube 21 is smaller than that of the distribution pipe connected at a relatively high level to the heat transfer tube 21. As in Embodiment 3, this arrangement achieves a more appropriate pass balance of the refrigerant in the heat exchanger 20, thus maintaining high heat exchange efficiency.

Furthermore, according to Embodiment 4, the deterioration in pass balance in the heat exchanger 20 is prevented only by appropriately setting the inside diameters of the distribution pipes 73 and 83 and the inside diameters of the inlet pipes 372 and 382. In other words, as in Embodiment 3, the heat exchange efficiency in the outdoor unit 10 and the refrigeration cycle apparatus 200 can be increased by arranging the refrigerant distributors 370 and 380, which have a simple configuration and are easy to fabricate, in the heat exchanger 20.

Figure 11:
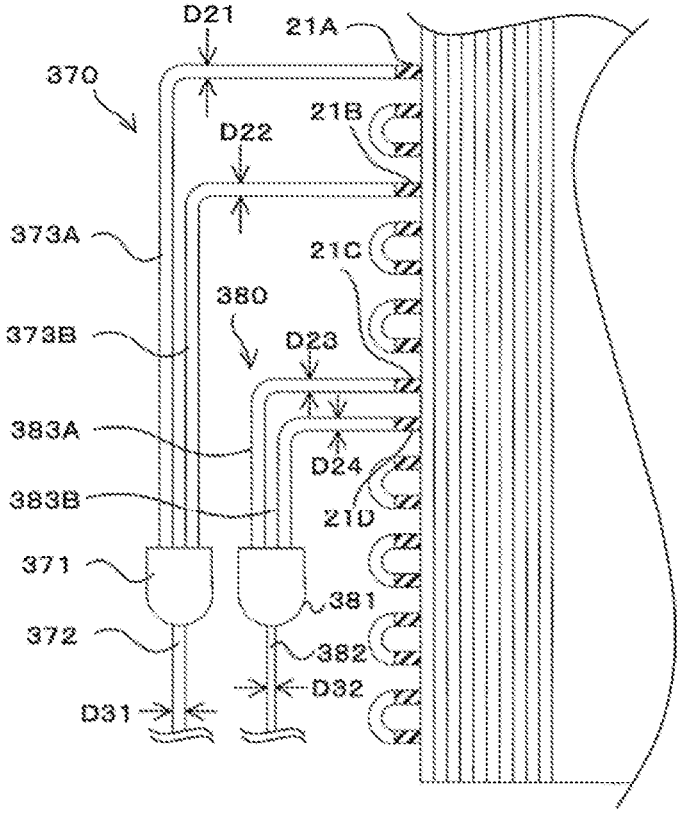
FIG. 11 is a diagram illustrating essential part of a heat exchanger according to a modification of Embodiment 3 of the present invention.

For each pair of the distribution pipes 373 and the distribution pipes 383 in Embodiments 3 and 4, the inside diameter of the distribution pipe connected at a relatively low level to the heat transfer tube 21 is smaller than that of the distribution pipe connected at a relatively high level to the heat transfer tube 21. The dimensional relationship is not limited to the above-described one. FIG. 11 is a diagram illustrating essential part of a heat exchanger according to a modification of Embodiment 3 of the present invention. As illustrated in FIG. 11, the inside diameter D21 of the distribution pipe 373A, the inside diameter D22 of the distribution pipe 373B, the inside diameter D23 of the distribution pipe 383A, and the inside diameter D24 of the distribution pipe 383B may be the same. Even in this case, the inside diameter D32 of the inlet pipe 382 of the refrigerant distributor 380 is smaller than the inside diameter D31 of the inlet pipe 372 of the refrigerant distributor 370. This arrangement offers the same advantages as those of Embodiments 3 and 4 described above. Although the refrigerant distributors 370 and 380 illustrated in FIG. 11 are configured for connection between the pressure reducing valve 60 and the heat exchanger 20 as in Embodiment 3, the arrangement of the refrigerant distributors 370 and 380 is not limited to the above-described one. As in Embodiment 4, the refrigerant distributors 370 and 380 may be arranged inside the heat exchanger 20.

Embodiment 5

Figure 12:
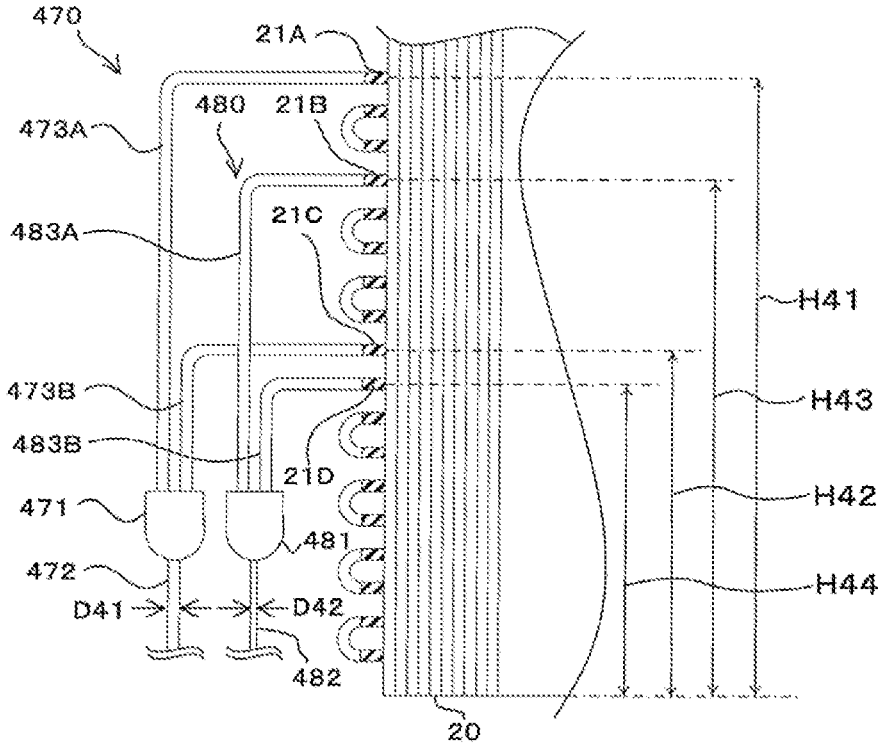
FIG. 12 is a diagram illustrating essential part of a heat exchanger according to Embodiment 5 of the present invention.

FIG. 12 is a diagram illustrating essential part of a heat exchanger according to Embodiment 5 of the present invention. A refrigerant distributor 470 includes a distributor body 471, an inlet pipe 472 through which the refrigerant flows into the refrigerant distributor, and distribution pipes 473A and 473B through which the refrigerant flows out of the refrigerant distributor. The distribution pipe 473A is connected to the heat transfer tube 21A of the heat exchanger 20, and the distribution pipe 473B is connected to the heat transfer tube 21C of the heat exchanger 20. A refrigerant distributor 480 includes a distributor body 481, an inlet pipe 482 through which the refrigerant flows into the refrigerant distributor, and distribution pipes 483A and 483B through which the refrigerant flows out of the refrigerant distributor. The distribution pipe 483A is connected to the heat transfer tube 21B of the heat exchanger 20, and the distribution pipe 483B is connected to the heat transfer tube 21D of the heat exchanger 20. The inlet pipes 472 and 482 are connected to a refrigerant pipe similar to the refrigerant pipe 40 in the above-described refrigerant circuit. In the following description, the distribution pipes 473A and 473B may be collectively referred to as "distribution pipes 473", and the distribution pipes 483A and 483B may be collectively referred to as "distribution pipes 483".

An average value of a level H43 of the distribution pipe 483A connected to the heat transfer tube 21B and a level H44 of the distribution pipe 483B connected to the heat transfer tube 21D is less than an average value of a level H41 of the distribution pipe 473A connected to the heat transfer tube 21A and a level H42 of the distribution pipe 473B connected to the heat transfer tube 21C. The level of the distribution pipe 483A connected at the highest level in the refrigerant distributor 480 to the heat transfer tube 21 is higher than the level of the distribution pipe 473B connected at the lowest level in the refrigerant distributor 470 to the heat transfer tube 21. In other words, the level of the distribution pipe 483B of the refrigerant distributor 480 connected to the heat transfer tube 21A is higher than the level of the distribution pipe 473B of the refrigerant distributor 470 connected to the heat transfer tube 21C. The inlet pipe 482 of the refrigerant distributor 480 has an inside diameter D42, which is smaller than an inside diameter D41 of the inlet pipe 472 of the refrigerant distributor 470.

In Embodiment 5, the distribution pipes 473 of the refrigerant distributor 470 and the distribution pipes 483 of the refrigerant distributor 480, which is separate from the refrigerant distributor 470, are alternately connected to the heat transfer tubes 21 in the top-bottom direction. In such a configuration, the inside diameter D42 of the inlet pipe 482 of the refrigerant distributor 480 having a low average value of the levels of the distribution pipes 483 connected to the heat transfer tubes 21 is smaller than the inside diameter D41 of the inlet pipe 472 of the refrigerant distributor 470 having a high average value of the levels of the distribution pipes 473 connected to the heat transfer tubes 21. This arrangement, in which the distribution pipes of the different refrigerant distributors are alternately connected to the heat transfer tubes in the top-bottom direction, also offers the same advantages as those of Embodiments 1 to 4 described above.

Embodiment 6

Figure 13:
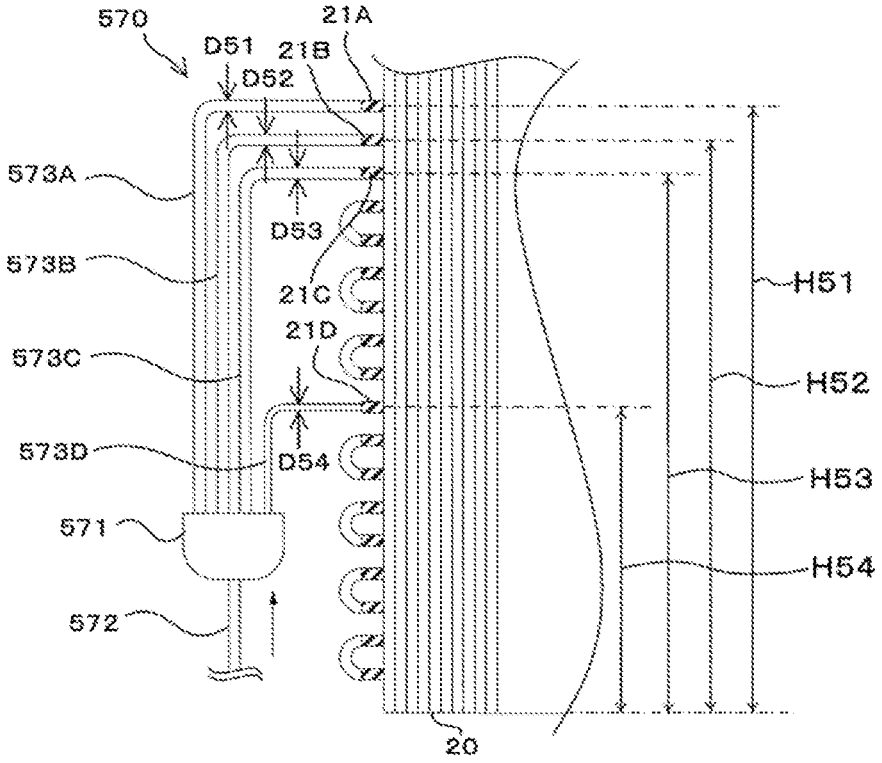
FIG. 13 is a diagram illustrating essential part of a heat exchanger according to Embodiment 6 of the present invention.

FIG. 13 is a diagram illustrating essential part of a heat exchanger according to Embodiment 6 of the present invention. A refrigerant distributor 570 includes a distributor body 571, an inlet pipe 572 through which the refrigerant flows into the refrigerant distributor, and distribution pipes 573A, 573B, 573C, and 573D through which the refrigerant flows out of the refrigerant distributor. The distribution pipe 573A is connected to the heat transfer tube 21A of the heat exchanger 20, the distribution pipe 573B is connected to the heat transfer tube 21B of the heat exchanger 20, the distribution pipe 573C is connected to the heat transfer tube 21C of the heat exchanger 20, and the distribution pipe 573D is connected to the heat transfer tube 21D of the heat exchanger 20. In the following description, the distribution pipes 573A, 573B, 573C, and 573D may be collectively referred to as "distribution pipes 573".

A level H52 of the distribution pipe 573B connected to the heat transfer tube 21B is lower than a level H51 of the distribution pipe 573A connected to the heat transfer tube 21A. A level H53 of the distribution pipe 573C connected to the heat transfer tube 21C is lower than the level H52 of the distribution pipe 573B connected to the heat transfer tube 21B. A level H54 of the distribution pipe 573D connected to the heat transfer tube 21D is lower than the level H53 of the distribution pipe 573C connected to the heat transfer tube 21C.

The distribution pipe 573A has an inside diameter D51, the distribution pipe 573B has an inside diameter D52, and the distribution pipe 573C has an inside diameter D53. The distribution pipes 573A, 573B, and 573C are of the same inside diameter. The distribution pipe 573D has an inside diameter D54, which is smaller than the inside diameter, D51, D52, and D53, of the distribution pipes 573A, 573B, and 573C. In other words, the three distribution pipes 573A, 573B, and 573C connected at relatively high levels to the heat transfer tubes 21 have the same inside diameter, which is larger than the inside diameter of the distribution pipe 573D connected at a relatively low level to the heat transfer tube 21.

According to Embodiment 6, a deterioration in pass balance of the refrigerant in the heat exchanger 20 can be prevented, and a reduction in heat exchange efficiency can be prevented. In addition, the use of the four distribution pipes 573 of two types, or two different inside diameters, facilitates fabrication of the heat exchanger.

Figure 14:
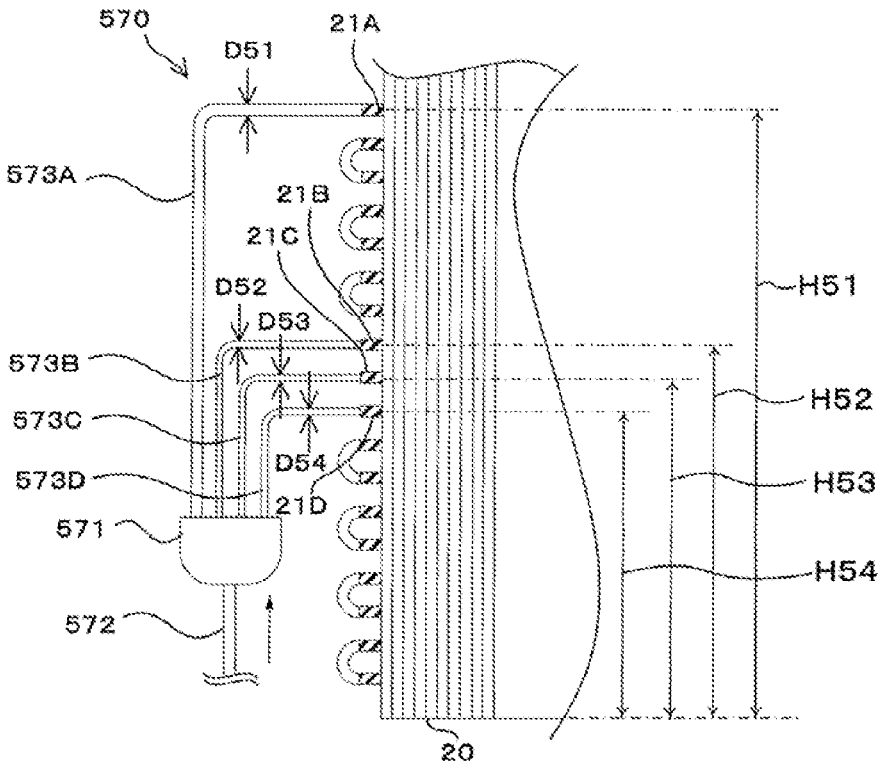
FIG. 14 is a diagram illustrating essential part of a heat exchanger according to a modification of Embodiment 6 of the present invention.

FIG. 14 is a diagram illustrating essential part of a heat exchanger according to a modification of Embodiment 6 of the present invention. In this modification, the inside diameter D52 of the distribution pipe 573B, the inside diameter D53 of the distribution pipe 573C, and the inside diameter D54 of the distribution pipe 573D are the same. The inside diameter D51 of the distribution pipe 573A is larger than the inside diameter, D52, D53, and D54, of the distribution pipes 573B, 573C, and 573D. In other words, the three distribution pipes 573B, 573C, and 573D connected at relatively low levels to the heat transfer tubes 21 have the same inside diameter, which is smaller than the inside diameter of the distribution pipe 573A connected at a relatively high level to the heat transfer tube 21. Therefore, this modification offers the same advantages as those of Embodiment 6 described above.

In Embodiment 6 and the modification of Embodiment 6, three of the four distribution pipes 573 have the same inside diameter. The fourth distribution pipe 573 has a different inside diameter, which depends on a relative level of the distribution pipe connected to the heat transfer tube 21. The dimensional relationship is not limited to the above-described one. For example, under conditions where the levels of the four distribution pipes 573 connected to the heat transfer tubes 21 are at equal distances, the inside diameters of the distribution pipes 573 may be set in the following manner: two distribution pipes 573 connected at relatively low levels to the heat transfer tubes 21 have a smaller inside diameter than the other two distribution pipes 573 connected at relatively high levels to the heat transfer tubes 21, the two distribution pipes 573 connected at the relatively low levels to the heat transfer tubes 21 have the same inside diameter, and the two distribution pipes 573 connected at the relatively high levels to the heat transfer tubes 21 have the same inside diameter. As described above, reducing the number of types of distribution pipes 573 connected to the heat transfer tubes 21 in accordance with the situation of connection to the heat transfer tubes 21 further facilitates the fabrication of the heat exchanger.

In Embodiment 6 and the modification of Embodiment 6, the number of refrigerant distributors is one. Any number of refrigerant distributors may be arranged. If a plurality of refrigerant distributors are arranged, the inside diameters of the distribution pipes of each refrigerant distributor may be set based on the differences in level between the distribution pipes connected to the heat transfer tubes 21.

Although the refrigerant circuit for the heating operation has been described as an example in each of Embodiments 1 to 6, Embodiments are not limiting. The refrigerant distributors in Embodiments 1 to 6 can be used for a heat exchanger included in a refrigerant circuit for a cooling operation. For the cooling operation, for example, the refrigeration cycle apparatus 100 according to Embodiment 1 illustrated in FIG. 2 will be described as an example. The outdoor unit includes the compressor 30, the heat exchanger 50, and the pressure reducing valve 60. The indoor unit includes the heat exchanger 20 and the refrigerant distributor 70. The refrigerant distributor 70 is configured such that the multiple distribution pipes 73 have the above-described inside diameter or diameters. Such a configuration can prevent a deterioration in pass balance in the heat exchanger 20 operating as an evaporator and a reduction in heat exchange efficiency.

The invention claimed is:

1. A heat exchange unit comprising:

a heat exchanger including a plurality of heat transfer tubes; and a plurality of refrigerant distributors, wherein each of the plurality of refrigerant distributors includes an inlet pipe through which refrigerant flows into a respective refrigerant distributor, and a plurality of distribution pipes through which the refrigerant flows out of the plurality of refrigerant distributors, each of the plurality of distribution pipes being connected to a respective heat transfer tube, and wherein among any two refrigerant distributors, the inlet pipe of the refrigerant distributor having a lower average value of levels of respective distribution pipes connected to respective heat transfer tubes has a smaller inside diameter than an inside diameter of the inlet pipe of the refrigerant distributor having a higher average value of levels of respective distribution pipes connected to respective heat transfer tubes.

2. The heat exchange unit of claim 1, wherein in each of the plurality of refrigerant distributors, among any two distribution pipes, the distribution pipe that is connected at a lower level to a respective heat transfer tube has a smaller inside diameter than an inside diameter of the distribution pipe that is connected at a higher level to a respective heat transfer tube.

3. The heat exchange unit of claim 1, wherein among any two refrigerant distributors, the level of the distribution pipe that is included in the plurality of distribution pipes of the refrigerant distributor having a lower average value of the levels of respective distribution pipes connected to respective heat transfer tubes and that is connected at the highest level to a respective heat transfer tube is higher than the level of the distribution pipe that is included in the plurality of distribution pipes of the refrigerant distributor having a higher average value of the levels of respective distribution pipes connected to respective heat transfer tubes and that is connected at the lowest level to a respective heat transfer tube.

4. A refrigeration cycle apparatus comprising:

a refrigerant circuit in which a compressor, a condenser, a pressure reducing valve, and an evaporator are sequentially connected by a refrigerant pipe; and a plurality of refrigerant distributors, wherein the evaporator includes a plurality of heat transfer tubes, wherein each of the plurality of refrigerant distributors includes an inlet pipe through which refrigerant in the refrigerant circuit flows into a respective refrigerant distributor, and a plurality of distribution pipes through which the refrigerant flows out of the plurality of refrigerant distributors, each of the plurality of distribution pipes being connected to a respective heat transfer tube, and wherein among any two refrigerant distributors, the inlet pipe of the refrigerant distributor having a lower average value of levels of respective distribution pipes connected to respective heat transfer tubes has a smaller inside diameter than an inside diameter of the inlet pipe of the refrigerant distributor having a higher average value of levels of respective distribution pipes connected to respective heat transfer tubes.

5. The refrigeration cycle apparatus of claim 4, wherein the plurality of refrigerant distributors is connected between the pressure reducing valve and the evaporator.

6. The refrigeration cycle apparatus of claim 4, wherein the plurality of refrigerant distributors is disposed inside the evaporator.

7. A refrigeration cycle apparatus comprising:

a refrigerant circuit in which a compressor, a condenser, a pressure reducing valve, and an evaporator are sequentially connected by a refrigerant pipe; and a plurality of refrigerant distributors, wherein the evaporator includes a plurality of heat transfer tubes, wherein each of the plurality of refrigerant distributors includes an inlet pipe through which refrigerant in the refrigerant circuit flows into a respective refrigerant distributor, and a plurality of distribution pipes through which the refrigerant flows out of the plurality of refrigerant distributors, each of the plurality of distribution pipes being connected to a respective heat transfer tube, and wherein among any two refrigerant distributors, the inlet pipe of the refrigerant distributor having a lower average value of levels of respective distribution pipes connected to respective heat transfer tubes has a smaller inside diameter than an inside diameter of the inlet pipe of the refrigerant distributor having a higher average value of levels of respective distribution pipes connected to respective heat transfer tubes, and wherein among any two refrigerant distributors, the level of the distribution pipe that is included in the plurality of distribution pipes of the refrigerant distributor having a lower average value of the levels of respective distribution pipes connected to respective heat transfer tubes and that is connected at the highest level to a respective heat transfer tube is higher than the level of the distribution pipe that is included in the plurality of distribution pipes of the refrigerant distributor having a higher average value of the levels of respective distribution pipes connected to respective heat transfer tubes and that is connected at the lowest level to a respective heat transfer tube.

* * * * *